US010441825B2

(12) United States Patent
Leca et al.

(10) Patent No.: US 10,441,825 B2
(45) Date of Patent: Oct. 15, 2019

(54) STABILIZING DEVICE FOR SPREADING TOOLS

(71) Applicant: T&J Rescue Enterprises, LLC, West Hartford, CT (US)

(72) Inventors: Anthony R. Leca, Watertown, CT (US); John H. Winterberger, Jr., Tolland, CT (US); Randall S. McHugh, Avon, CT (US)

(73) Assignee: T&J RESCUE ENTERPRISES, LLC, West Hartford, CT (US)

( * ) Notice: Subject to any disclaimer, the term of this patent is extended or adjusted under 35 U.S.C. 154(b) by 138 days.

(21) Appl. No.: 15/603,543

(22) Filed: May 24, 2017

(65) Prior Publication Data

US 2017/0348554 A1 Dec. 7, 2017

Related U.S. Application Data

(60) Provisional application No. 62/345,056, filed on Jun. 3, 2016.

(51) Int. Cl.

| | |
|---|---|
| ***A62B 3/00*** | (2006.01) |
| ***B66F 3/00*** | (2006.01) |
| ***B66F 3/25*** | (2006.01) |

(52) U.S. Cl.

CPC ..... *A62B 3/005* (2013.01); *B66F 3/00* (2013.01); *B66F 3/005* (2013.01); *B66F 3/25* (2013.01)

(58) Field of Classification Search

CPC ..... A62B 3/00; A62B 3/005; A62B 99/00; B66F 3/00; B66F 3/005; B66F 3/25

See application file for complete search history.

(56) References Cited

U.S. PATENT DOCUMENTS

| | | | | |
|---|---|---|---|---|
| 2,952,443 | A * | 9/1960 | Camarero | B66F 3/005 254/94 |
| 5,048,795 | A * | 9/1991 | Vitale | A62B 3/005 254/93 R |
| 6,053,477 | A * | 4/2000 | Price | B60S 9/04 254/94 |
| 6,431,522 | B1 * | 8/2002 | Cutrell, Sr. | A62B 3/005 254/1 |
| 7,240,885 | B1 * | 7/2007 | Sullivan | E04G 25/06 248/354.1 |
| 7,434,785 | B1 * | 10/2008 | McMorrow | A62B 3/005 254/134 |

* cited by examiner

*Primary Examiner* — Joseph J Hail
*Assistant Examiner* — Timothy Brian Brady
(74) *Attorney, Agent, or Firm* — Cantor Colburn LLP

(57) ABSTRACT

Stabilizing devices and methods of use for stabilizing spreading tools are provided. The stabilizing device includes a base having a first surface and a second surface, a first tower extending from the first surface having a first aperture formed therein, a second tower extending from the first surface having a second aperture formed therein, wherein the second tower is separated from the first tower by a tower span configured to receive a portion of the spreading tool, an engagement pin removably receivable through the first and second apertures, extend across the tower span, and configured to engage with a portion of a spreading tool, and a rail extending from the first surface and configured to stop movement of a spreading tool that is engaged with the engagement pin between the first and second towers.

16 Claims, 8 Drawing Sheets

STABILIZING DEVICE FOR SPREADING TOOLS

CROSS-REFERENCE TO RELATED APPLICATIONS

The present application claims priority from U.S. Provisional Patent Application No. 62/345,056, filed Jun. 3, 2016. The contents of the priority application are hereby incorporated by reference in their entirety.

BACKGROUND

The subject matter disclosed herein generally relates to stabilizing devices and, more particularly, to stabilizing devices for spreading tools.

Various rescue tools are used for aiding in rescue operations during emergency situations. For example, rescue spreader tools, hereinafter "spreader tool," can be used to aid in lifting vehicles, separating structural elements of vehicles or other structures, etc. Spreader tools are typically configured to be operated manually, i.e., held by an operator. However, during operation, a spreader tool may require operation below a vehicle and thus be supported by the ground. The spreader tool can be used to lift a vehicle, or otherwise apply a force upward against a structure (e.g., a vehicle body), but may tilt or otherwise shift based on the supporting ground.

SUMMARY

According to one embodiment, a stabilizing device for stabilizing a spreading tool is provided. The stabilizing device includes a base having a first surface and a second surface, a first tower extending from the first surface having a first aperture formed therein, a second tower extending from the first surface having a second aperture formed therein, wherein the second tower is separated from the first tower by a tower span configured to receive a portion of the spreading tool, an engagement pin removably receivable through the first and second apertures, extend across the tower span, and configured to engage with a portion of a spreading tool, and a rail extending from the first surface and configured to stop movement of a spreading tool that is engaged with the engagement pin between the first and second towers.

In addition to one or more of the features described above, or as an alternative, further embodiments of the stabilizing device may include a traction element configured on the second surface, the traction element configured to increase traction between the base and a ground surface.

In addition to one or more of the features described above, or as an alternative, further embodiments of the stabilizing device may include that the traction element is integrally formed with the base.

In addition to one or more of the features described above, or as an alternative, further embodiments of the stabilizing device may include that the traction element is attached to the second surface.

In addition to one or more of the features described above, or as an alternative, further embodiments of the stabilizing device may include that the traction element comprises at least one of chevron ribs, sine wave ribs, pyramid teeth, or a patterned structure on the second surface.

In addition to one or more of the features described above, or as an alternative, further embodiments of the stabilizing device may include a first support extending from a surface of the first tower to the first surface of the base and a second support extending from a surface of the second tower to the first surface of the base.

In addition to one or more of the features described above, or as an alternative, further embodiments of the stabilizing device may include a locking mechanism configured to engage with the pin to secure the pin in the first and second apertures of the first and second towers.

In addition to one or more of the features described above, or as an alternative, further embodiments of the stabilizing device may include that the tower span is 2.25 inches (5.72 cm).

In addition to one or more of the features described above, or as an alternative, further embodiments of the stabilizing device may include that the tower span is 1.625 inches (4.128 cm).

In addition to one or more of the features described above, or as an alternative, further embodiments of the stabilizing device may include a recess formed in the first surface between the rail and the towers, the recess configured to receive a portion of the spreading tool to prevent movement of the spreading tool relative to the base.

In addition to one or more of the features described above, or as an alternative, further embodiments of the stabilizing device may include that the base has at least one dimension that is 6 inches (15.24 cm).

In addition to one or more of the features described above, or as an alternative, further embodiments of the stabilizing device may include that a width and a length of the base are each 6 inches (15.24 cm).

According to other embodiments, stabilizing devices as shown and described herein are provided.

According to other embodiments, safety operations performed as shown and described herein are provided.

According to other embodiments, methods of using a spreading tool as shown and described herein are provide.

Technical effects of embodiments of the present disclosure include a stabilizing device configured to stabilize and support a spreading tool used in emergency operations.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

In order to provide and aid in the stability of operation of a spreader tool, embodiments provided herein are directed to a stabilizing device that can removably attach to a spreader tool to apply stability thereto. For example, in some embodiments, a stabilizing device can have a sufficiently large base to provide support and stability. Further, in some embodiments, a base may be sufficiently small to enable portability and relatively light weight such that an operator can easily move, adjust, and otherwise carry the stabilizing device.

Figure 1:
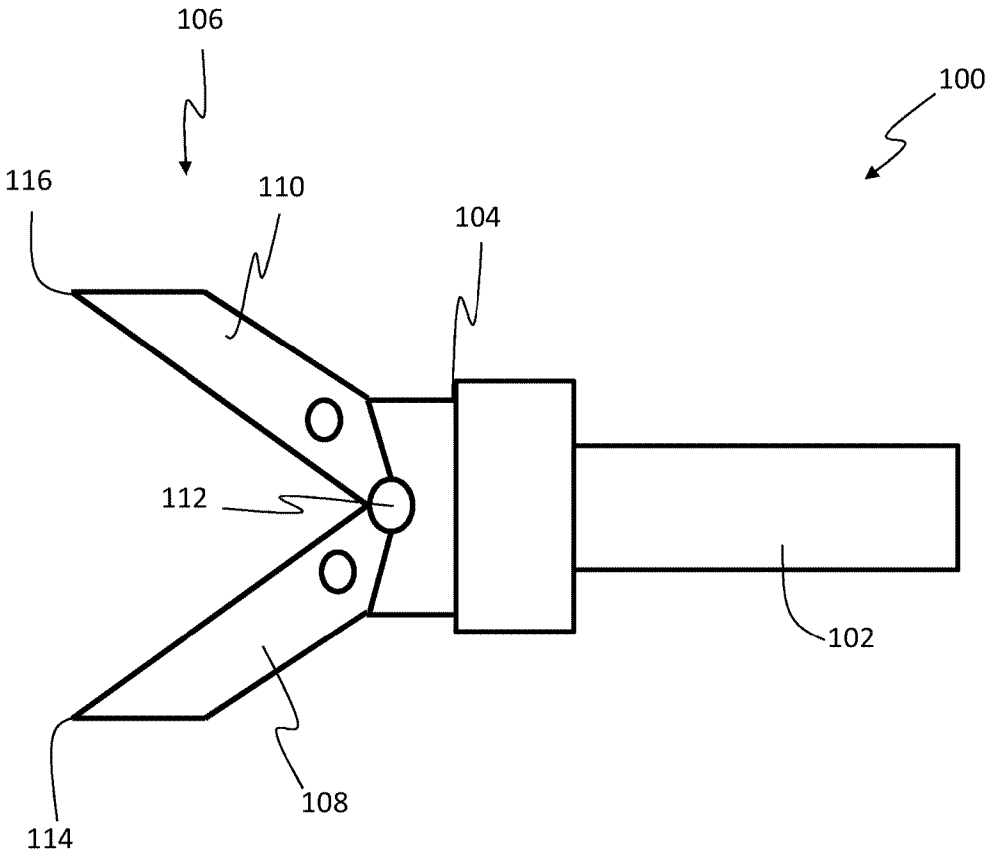
FIG. 1 a schematic illustration of a spreading tool.

Embodiments of stabilizing devices, as provided herein, are designed and configured to work and operate with any spreader tool, and thus enables universal operation and compatibility with various spreader tool configurations. For example, turning to FIG. 1, an example embodiment of a spreader tool 100 in accordance with an embodiment of the present disclosure is shown. The spreader tool 100 includes a control handle 102, an operating body 104, and a spreading structure 106. The control handle 102 can include operating control buttons or other features to enable a user to control the operation of the spreader tool 100. The operating body 104 can include a motor, pistons, gears, pneumatic elements, etc. that are configured to apply force and thus control and operate the spreading structure 106. In some embodiments, the control handle 102 can incorporate all or some of the elements of the operating body 104. The control handle 102 and/or the operating body 104 can include power sources and/or connecting elements to supply power to the spreader tool 100 (e.g., power cord, battery, gas motor, etc.).

The spreading structure 106, as shown, includes a first arm 108 and a second arm 110. The first and second arms 108, 110 can form a jaw or other structure, and as shown, are hinged about a pivot 112. The first arm 108 includes a first tip 114 and the second arm 110 includes a second tip 116. The arms 108, 110 and/or tips 114, 116 can be configured to include surfaces and/or features that are designed to enable lifting of structures (e.g., vehicles) and/or can include cutting elements that are configured to cut into and/or through structural elements of a vehicle or other body.

In a spreading/separation functionality, a user can place the spreader tool 100 beneath a vehicle with the first arm 108 on the ground and the second arm 110 in contact with a structure or surface of the vehicle. The user will then operate the spreader tool 100 to have the first and second arms 108, 110 spread or separate from each other such that the first arm 108 applies force into the ground and the second arm 110 applies force on the vehicle. As the arms 108, 110 spread apart, the vehicle can be lifted, thus enabling an emergency operation (e.g., a rescue) to occur (such as extraction of a passenger from within and/or under the vehicle).

One issue of using such a spreader tool 100 is that there may be issues of stability to enable proper and efficient lifting of a vehicle, particularly where every second may count. When handheld operation is used with the spreader tool 100, an operator must try to hold the spreader tool 100 steady such that it doesn't tilt in order to apply maximum force to a vehicle. Further, vehicle accidents may occur on terrain that is not level and/or solid. For example, soft ground may be present below a vehicle that must be lifted, and such ground may not enable efficient lifting force to be applied by the spreader tool 100.

Figure 2A:
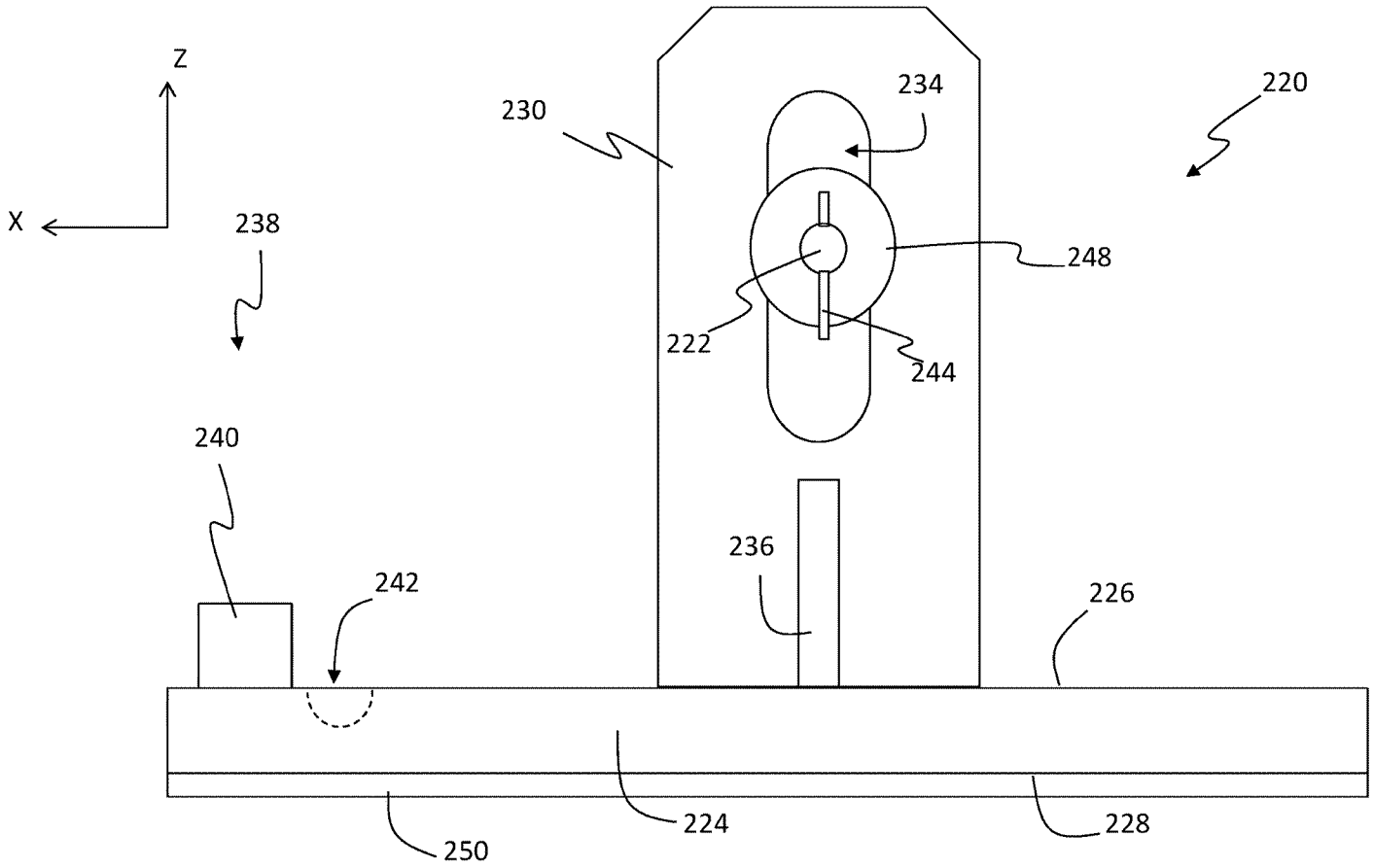
FIG. 2A is a side-elevation schematic illustration of a stabilizing device in accordance with an embodiment of the present disclosure.
Figure 2B:
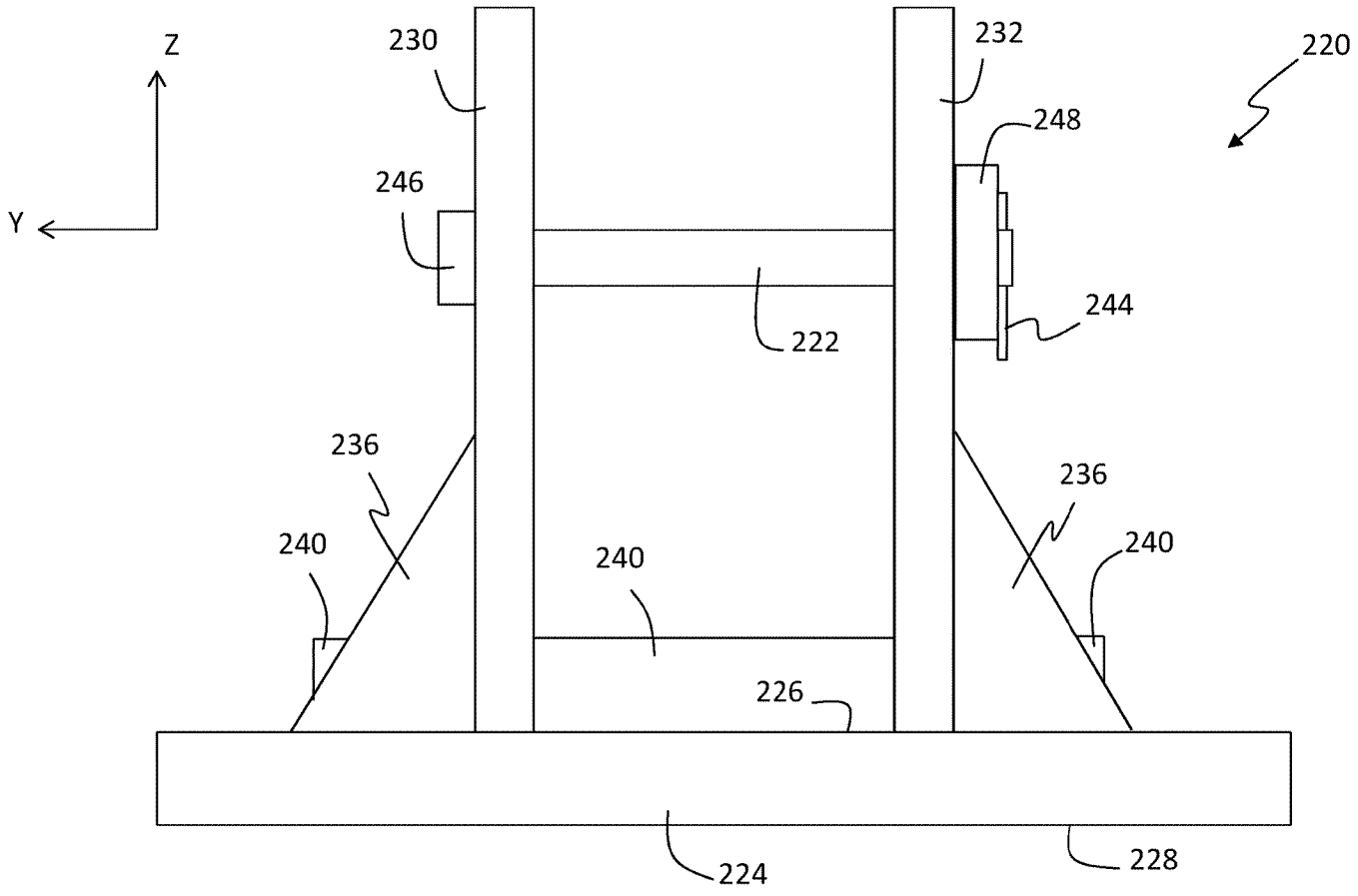
FIG. 2B is a rear-elevation schematic illustration of the stabilizing device of FIG. 2A.
Figure 2C:
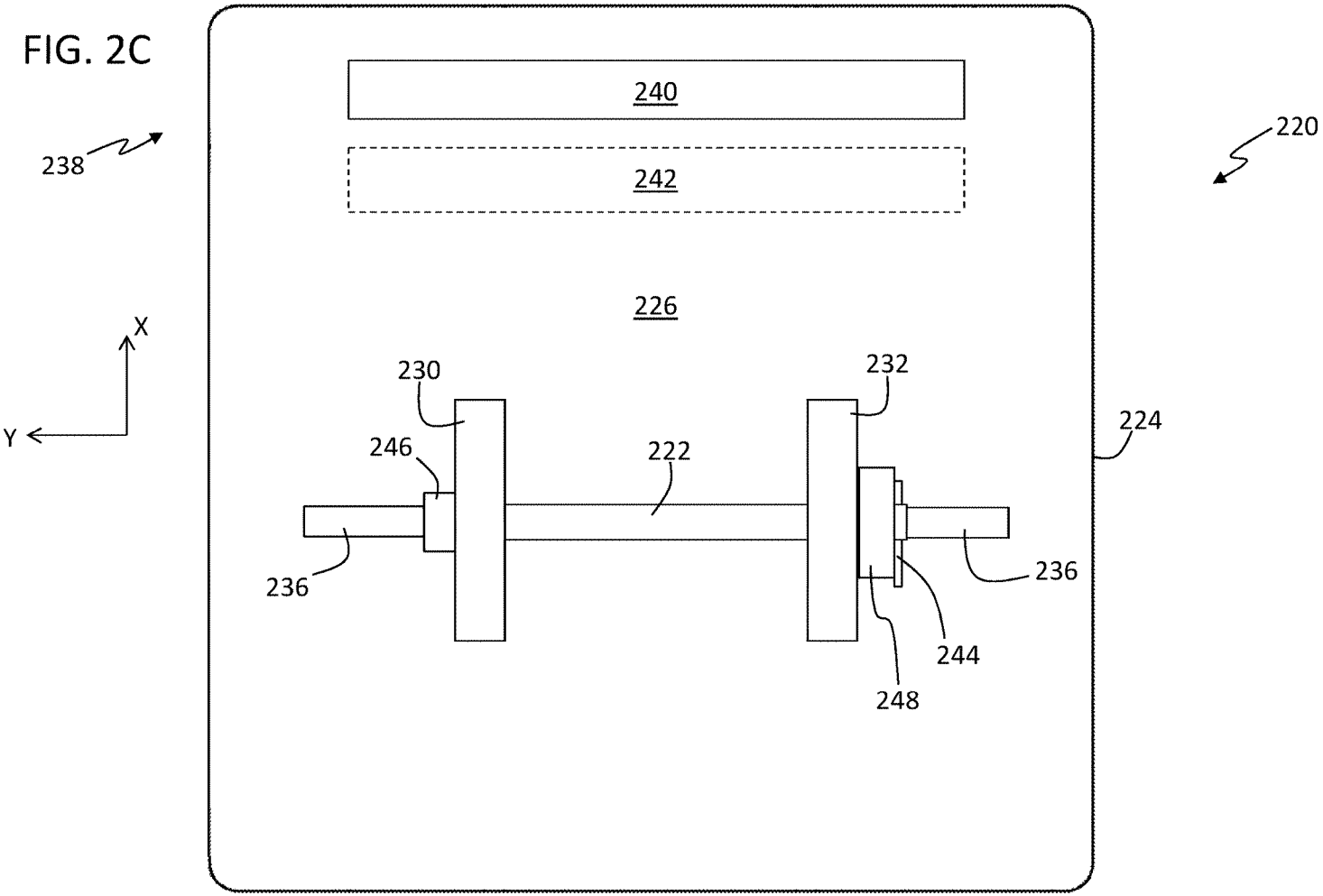
FIG. 2C is a top-down plan schematic illustration of the stabilizing device of FIG. 2A.

Accordingly, embodiments provided herein are directed to stabilizing devices that can provide stability and/or support to a spreader tool when employed therewith. For example, turning to FIGS. 2A-2C, schematic illustrations of a stabilizing device 220 in accordance with a non-limiting embodiment of the present disclosure is shown. FIG. 2A is a side elevation illustration, FIG. 2B is a back elevation illustration, and FIG. 2C is a top down plan illustration of the stabilizing device 220. A coordinate and/or reference system X-Y-Z is shown in FIGS. 2A-2C with the arrows indicating a positive direction. In some embodiments, the stabilizing device 220 can be formed from metal, alloys, or other materials, and can be machined, welded, cast, additively manufactured, or otherwise formed.

With reference to FIGS. 2A-2C, the stabilizing device 220 includes a base 224 having a first surface 226 and a second surface 228. A shown, the first surface 226 can be a top surface, and a first tower 230 and a second tower 232 can extend therefrom. Each tower 230, 232 is similar in shape, geometry, and structure. Each tower 230, 232 has an aperture 234 passing therethrough, with the apertures 234 configured and aligned to receive an engagement pin 222 to enable the engagement pin 222 to move vertically (e.g., in the Z-direction) within the apertures 234 with respect to the base 224. Further, as shown, each tower 230, 232 can include an optional support 236. The supports 236 can extend from a surface of the respective tower 230, 232 normal to said surface to the first surface 226 of the base 226. Accordingly, the supports 236 can provide structural support to the respective towers 230, 232.

The base 224 can be substantially square or rectangular shaped, with the first surface 226 and the second surface 228 defining parallel planes. The towers 230, 232 can be configured substantially in the center or squared about the center of the first surface 226. At a periphery or edge 238 of the first surface 226 is a rail 240 that is configured to stop a portion of a spreading tool when the spreading tool is engaged into the stabilizing device 220. Located between the rail 240 and the towers 230, 232 is a recess 242. The recess 242 forms a depression or channel within the first surface 226 of the base 224 and runs parallel to the rail 240 along the length of the base 224. The rail 240 and/or the recess 242 can be configured to receive a portion of the spreader tool to prevent movement of the spreader tool in the X-direction (positive or negative). For example, the rail 240 can be configured to prevent positive X-direction movement of a spreader tool and the recess 242 can be configured to prevent both positive and negative X-direction movement of the spreader tool. As shown in FIGS. 2A-2C, the rail 240 and the recess 242 do not extend the full width of the base 224. This is not to be limiting, and those of skill in the art will appreciate that the rail 240 and/or the recess 242 can take any shape, geometry, length, size, etc. without departing from the scope of the present disclosure.

The engagement pin 222 can include a locking mechanism 244, such as a locking pin or other element, structure, or feature, which can secure the engagement pin 222 movably within the apertures 234. The engagement pin 222 can have a head 246 at a first end and can receive the locking mechanism 244 at a second end. As shown, the engagement pin 222 is configured with an optional washer 248 at the second end, between the locking mechanism 244 and the second tower 232. Further, as shown, the head 246 of the engagement pin 222 is configured to stop against a surface of the first tower 230. Those of skill in the art will appreciate that the engagement pin 222 can be a bolt or other similarly structured element.

As shown in FIG. 2B, the engagement pin 222 is configured to pass through the first tower 230 and the second tower 232 (through the apertures 234). In operation, the engagement pin 222 is configured to pass through a portion of a spreading tool (e.g., pivot 112 of spreading tool 100 shown in FIG. 1). Thus the engagement pin 222 can secure a spreading tool within the stabilizing device 220. When engaged between the towers 230, 232, a spreading tool can be prevented from moving laterally (e.g., Y-direction). Further, as the arms of the spreading tool spread apart and a first arm contacts the base 224, the rail 240 and the recess 242 can be prevented lateral movement (e.g., X-direction). However, because of the apertures 234, the spreading tool can move vertically relative to the base (e.g., Z-direction).

For example, in one non-limiting example, when a spreading tool is inserted into the stabilizing device 220, a lower arm of the spreading tool can slide in between the towers 230, 232 and under the engagement pin 222 while the upper arm of the spreading tool stays above the engagement pin 222. As the arms of the spreading tool open, the tip of the lower arm can rest into and/or engage with the recess 242 and/or the rail 240. Such configuration stops or prevents the lower arm of the spreading tool from sliding out of the back side of the stabilizing device 220. As the arms of the spreading tool are opened and start to put pressure on the base 224 of the stabilizing device 220, the tip of the lower arm can engage with and/or in the recess 242 in front of the rail 240. Advantageously, the more pressure put on the lower arm (and thus on the base 224) the more stable the spreading tool becomes. The towers 230, 232 of the stabilizing device 220 prohibit any lateral movement (e.g., Y-direction) of the spreading tool, thus keeping the spreading tool stable. The engagement pin 222 is designed to reach the top of the apertures 234 before the arms of the spreading tool reach maximum opening.

In some non-limiting embodiments, the second surface 228 of the base 224 can be textured or otherwise equipped with a traction element 250. For example, in one non-limiting embodiment, the second surface 228 can be machined or otherwise formed to have a traction surface, including, but not limited to, chevron ridges, sine wave ridges, pyramid teeth, and/or other patterned structures that are part of the base 224. In other embodiments, the traction element 250 can be mounted to or otherwise attached and/or connected to the second surface 228 of the base 224. For example, in some non-limiting embodiments, a traction element 250 can be a rubber, composite, or otherwise different material than the rest of the stabilizing device 220. In such embodiments, the traction element 250 can be attached by any known mechanism, including, but not limited to, welding, adhesives, screws, bolts, and/or other fasteners and/or attachment mechanisms.

Figure 3A:
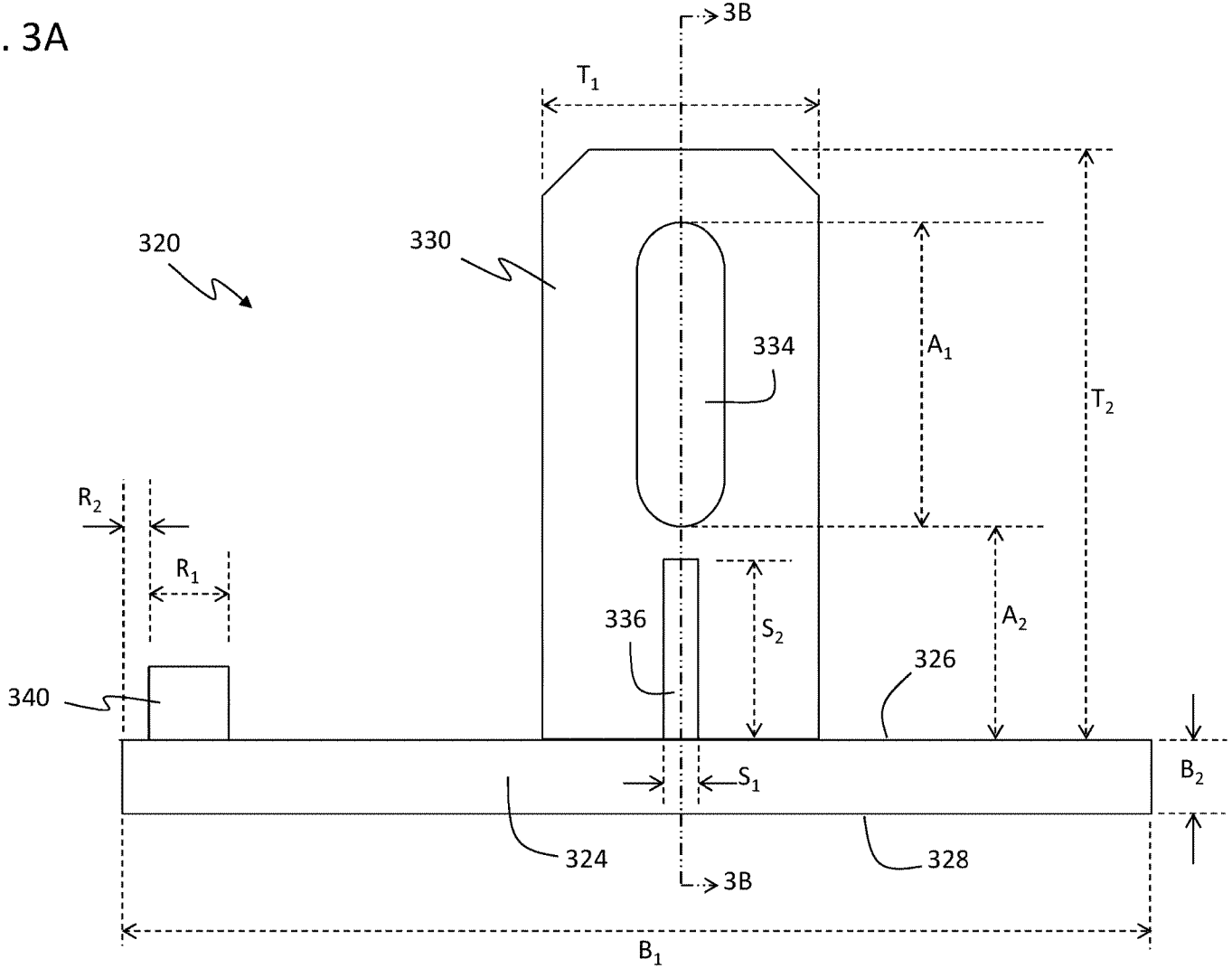
FIG. 3A is a side schematic illustration of another configuration of a stabilizing device in accordance with the present disclosure.
Figure 3B:
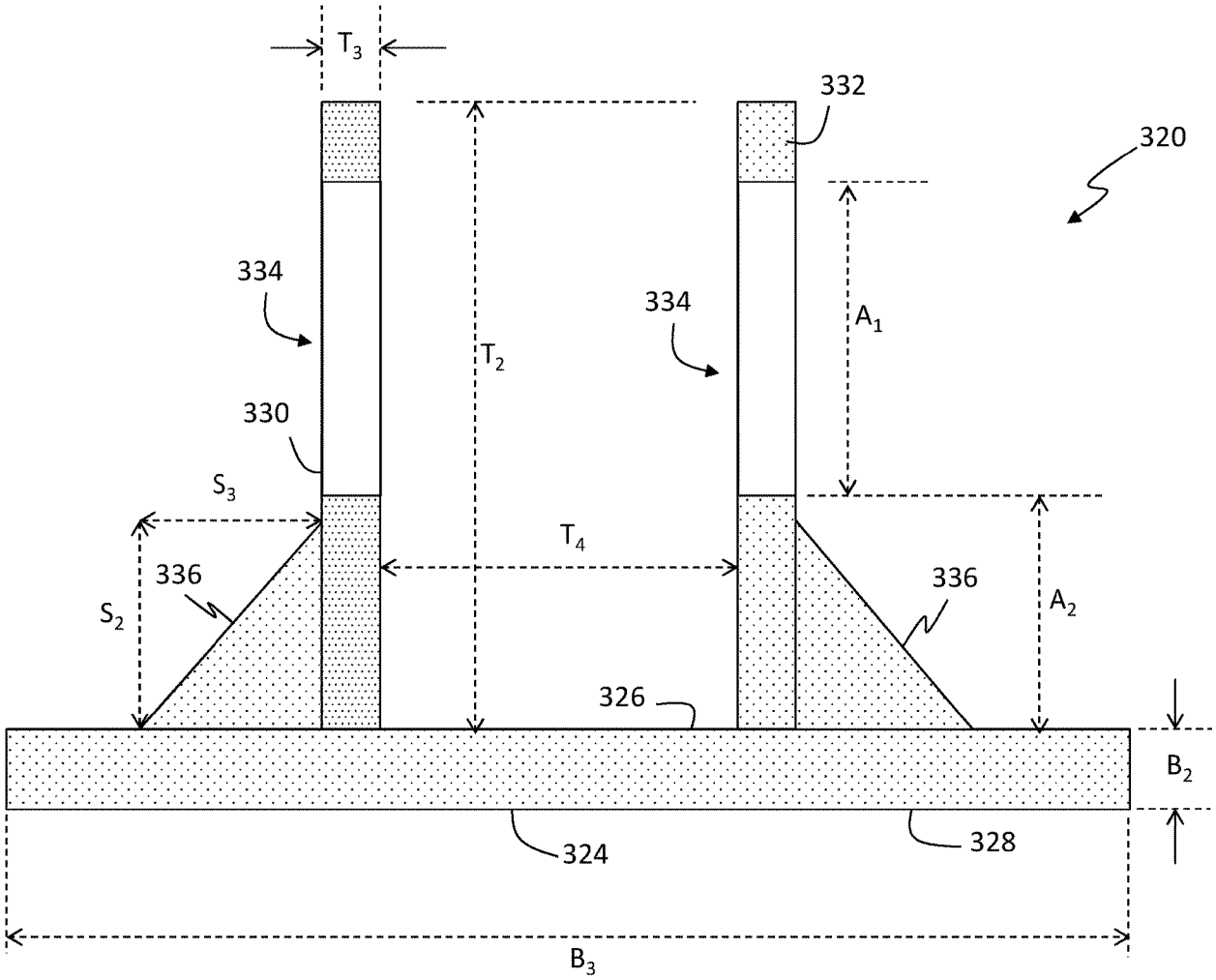
FIG. 3B is a cross-sectional schematic illustration of the stabilizing device of FIG. 3A as viewed along the line 3B-3B.

Turning now to FIGS. 3A-3B, an alternative configuration of a stabilizing device 320 in accordance with the present disclosure is shown. As shown, the stabilizing device 320 does not include the recess or the traction element shown and described above. FIG. 3A is a side elevation illustration of the stabilizing device 320 and FIG. 3B is a cross-sectional illustration along the line 3B-3B indicated in FIG. 3A.

As shown, the stabilizing device 320 includes a base 324 with a first surface 326 and a second surface 328. A first tower 330 and a second tower 332 extend from the first surface 326 of the base 324. Each tower 330, 332 includes a support 336 and an aperture 334. The base 324 has a base width $B_1$ a base height $B_2$, and a base length $B_3$. In some embodiments, the base width $B_1$ and the base length $B_3$ can be equal (e.g., a square base). The towers 330, 332 are structurally similar and have a tower width $T_1$, a tower height $T_2$, and a tower length (or thickness) $T_3$. The towers 330, 332 are separated by a span $T_4$.

The apertures 334 formed in the towers 330, 332 have an aperture length $A_1$ that defines the vertical extend that the pin can move when installed to the stabilizing device 320 (e.g., as shown and described above). The apertures 334 are positioned an aperture distance $A_2$ from the top surface 326 of the base 324. As shown, the aperture distance $A_2$ is a distance between the top surface 326 an the lowest extend of the aperture 334.

The supports 336 have a support width $S_1$, a support height $S_2$, and a support length $S_3$. In some embodiments, the support height $S_2$ and the support length $S_3$ can be equal. The rail 340 can have a rail width $R_1$ and can be positioned a rail distance $R_2$ from an edge of the base 324.

Figure 4A:
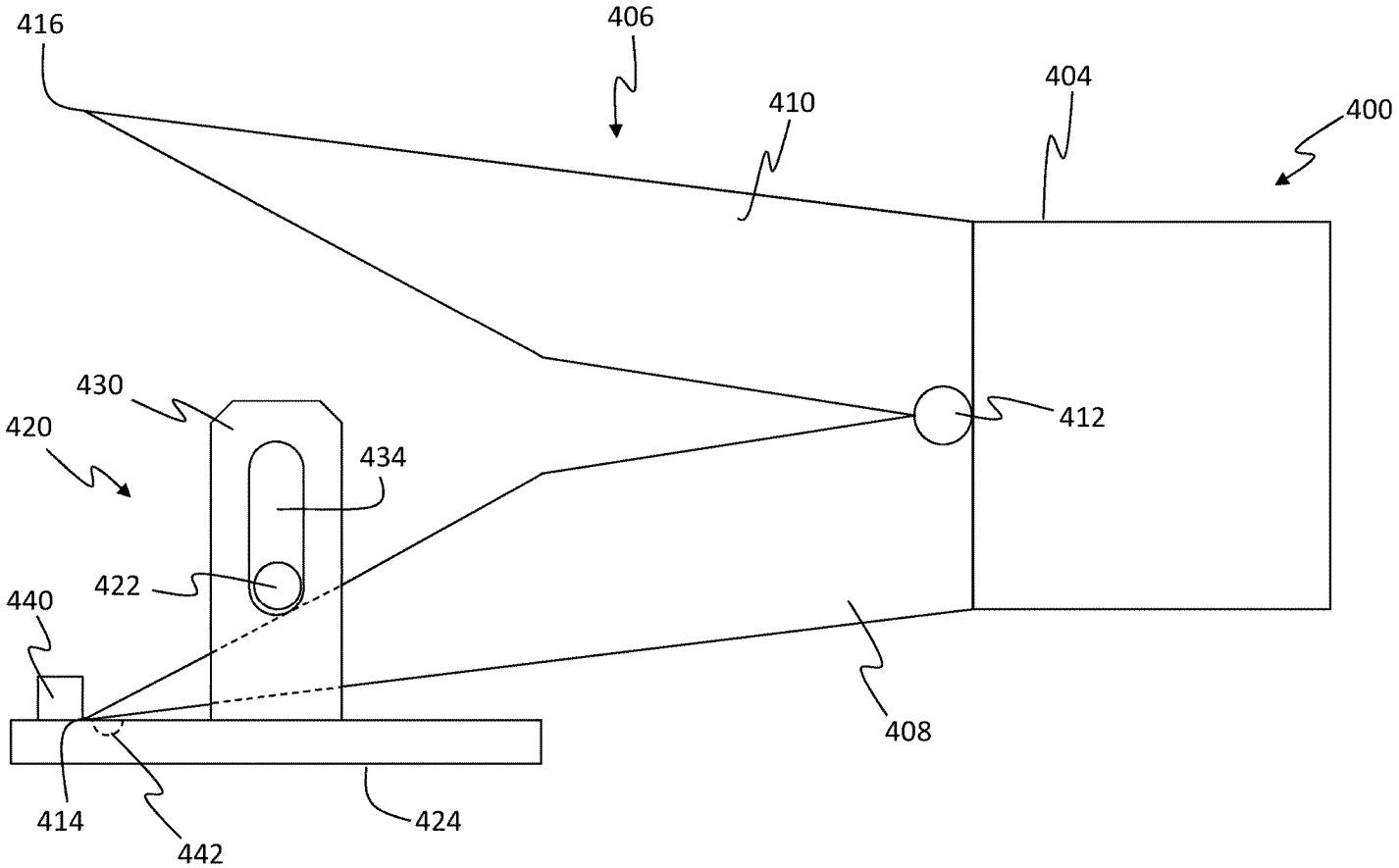
FIG. 4A is a schematic illustration of a spreading tool as inserted into a stabilizing device in accordance with an embodiment of the present disclosure, in a first position.
Figure 4B:
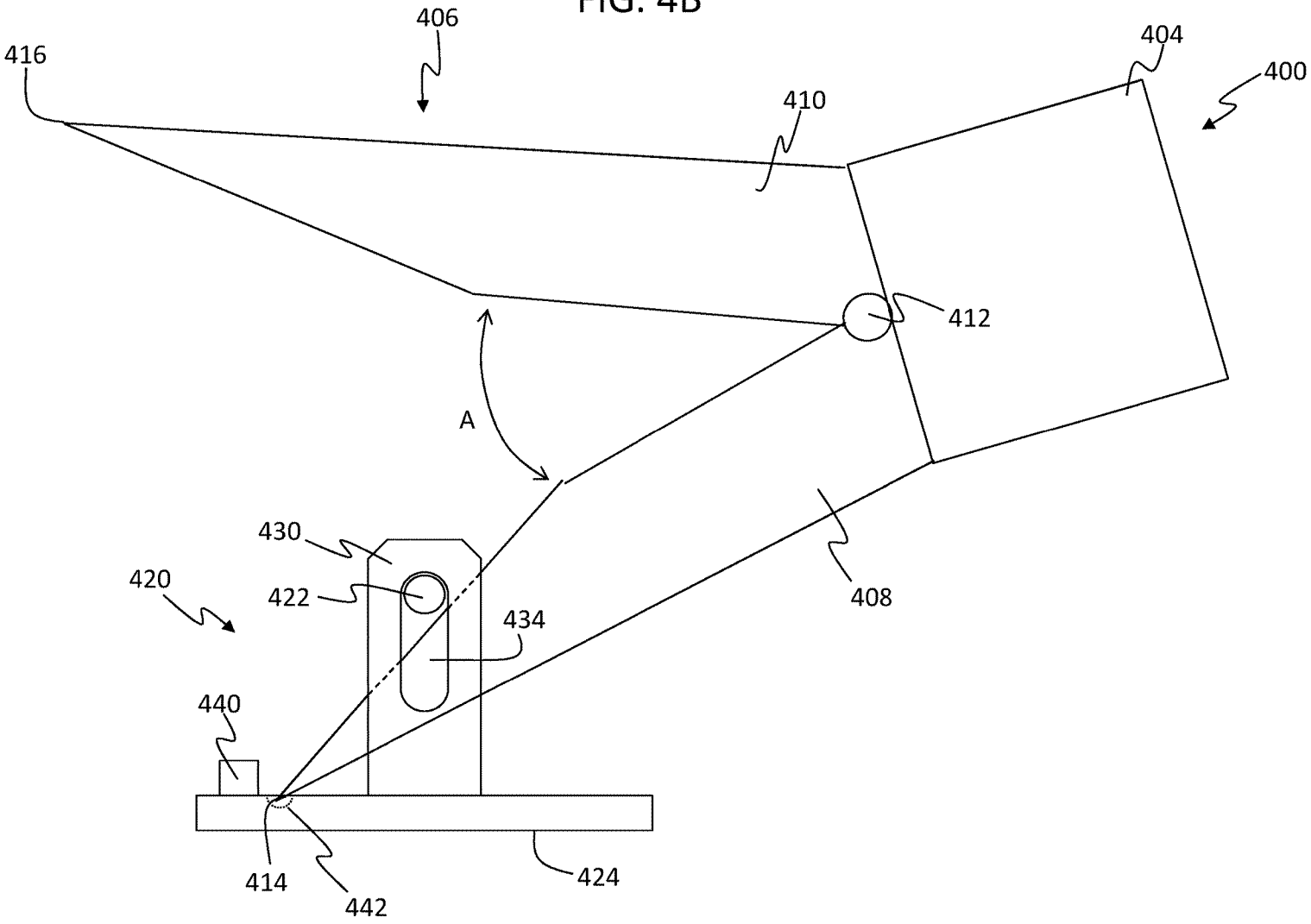
FIG. 4B is a schematic illustration of the spreading tool and stabilizing device of FIG. 4A, in a second position.

Turning now to FIGS. 4A-4B, schematic illustrations of using a spreading tool with a stabilizing device in accordance with an embodiment of the present disclosure are shown. FIG. 4A illustrates a spreading tool 400 having an operating body 404 and a spreading structure 406, similar to that described above with respect to FIG. 1, installed into a stabilizing device 420 in a first position. FIG. 4B illustrates the spreading tool 400 in a second (e.g., spread position) and engaged with the stabilizing device 420.

The spreading structure 406 includes a first arm 408 and a second arm 410 that are hinged about a pivot 412. The first arm 408 includes a first tip 414 and the second arm 410 includes a second tip 416. As shown, the stabilizing device 420 includes a base 424 with towers 430 extending therefrom. Although FIGS. 4A-4B are side views, those of skill in the art will appreciate that there are two towers 430 configured similar to that shown and described above. The towers 430 include parallel apertures 434 that receive an engagement pin 422. The base 424 also includes a rail 440 and a recess 442 as shown and described above.

As shown in FIG. 4A, the first arm 408 of the spreading tool 400 is engaged with and/or inserted into the stabilizing device 420 such that the first tip 414 and the first arm 408 are below the engagement pin 422 and the second tip 416 and the second arm 410 are above the engagement pin 422. That is, the engagement pin 422 is positioned between the first and second arms 408, 410 of the spreading tool 400. As shown in the first position, the first arm 408 does not lift the engagement pin 422 within the aperture 434, but the first tip 414 of the first arm 408 contacts the rail 440 of the stabilizing device 420.

As the spreading tool 400 is spread or opened (e.g., as shown in FIG. 4B), the first arm 408 lifts the engagement pin 422 within the aperture 434 and the first tip 414 slides into the recess 442. When the engagement pin 422 reaches the top of the aperture 434, the first arm 408 is secured and stabilized between the two towers 430 to achieve a first degree of stability and between the engagement pin 422 and the base 424 (e.g., the recess 442 and/or the rail 440) to achieve a second degree of stability, and the base 424 providing a third degree of stability as defined be the surface area of the base 424 that is in contact with the ground.

With the first arm 408 engaged within and to the stability device 420, the second arm 410 can spread away from the first arm 408 to lift a vehicle or other structure. As shown, the spreading tool 400 can have the two arms 408, 410 spread an angle A, which may be a predefined angle of the spreading tool 400 that is set based on safety requirements, structural requirements, etc. As such, those of skill in the art will appreciate that the stability device 420 does not interfere with the operation of the spreading tool 400.

As the first arm 408 rises during a spreading operation of the spreading tool 400, the first arm 408 acts on the engagement pin 422 such that the engagement pin 422 rises within the aperture 434 up to a maximum position (defined by the extent or length/height of the aperture 434). In the maximum position, the spreading tool 400 is stabilized and/or supported by the stability device 420 and efficient emergency and/or rescue operations using the spreading tool 400 can be achieved.

Those of skill in the art will appreciate that the various dimensions shown and described above can be any desired dimension and can be selected based on a desired range of size of spreading tools to be accommodated. For example, in one non-limiting embodiments, the base 324 of the stabilizing device 320 can have a base width $B_1$ and base length $B_3$ equal to 6 inches (15.24 cm) and a base height $B_2$ equal to 0.5 inches (1.27 cm). Further, in some embodiments, the tower span $T_4$ can be 2.25 inches (5.72 cm), the tower height $T_2$ can be 4.25 (10.80 cm), and the tower width $T_3$ can be 0.5 inches (1.27 cm). Further, the aperture length $A_1$ can be 1.75 inches (4.45 cm) and the aperture distance $A_2$ can be 2.5 inches (6.35 cm). The support height $S_2$ and the support length $S_3$ can be 1.25 inches (3.18 cm) and the support width $S_1$ can be 0.375 inches (0.953 cm). In another non-limiting embodiment, the tower span $T_4$ can be 1.625 inches (4.128 cm) with all other dimensions the same. The different tower spans can be selected to accept different width or size spreading tools. In some embodiments, the rail can have a rail width $R_1$ equal to 0.625 inches (1.588 cm) and a rail distance $R_2$ equal to 0.25 inches (0.64 cm).

Those of skill in the art will appreciate that other sizes and dimensions can be used for the stabilizing devices as shown and described herein. Further, the pin can be configured and selected to ensure proper support and engage with a spreading tool. For example, the pin can be 0.625 inches (1.588 cm) in diameter and have a length selected to accommodate a particular tower span. The preceding pin diameter is merely for example only and is not intended to be limiting.

Advantageously, embodiments described herein provide a stabilizing device configured to support and stabilize a spreading device that can be used for emergency situations. Further, advantageously, stabilizing devices as provided herein can be removably connected to a spreading device such that the stabilizing device need be installed and/or attached to a spreading device when needed.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A stabilizing device for stabilizing a spreading tool, the stabilizing device comprising: a base having a first surface and a second surface; a first tower extending from the first surface having a first aperture formed therein, wherein the first aperture has an aperture length in a vertical direction relative to the base and the vertical length of the aperture is greater than the horizontal length of the aperture; second tower extending from the first surface having a second aperture formed therein, wherein the second tower is separated from the first tower by a tower span configured to receive a portion of the spreading tool, wherein the second aperture has an length in the vertical direction relative to the base that is the same as the aperture length of the first aperture; an engagement pin removably receivable through the first and second apertures, extending across the tower span, and configured to engage with a portion of a spreading tool, wherein the engagement pin is configured to move vertically within the first and second apertures along the aperture length; and a rail extending from the first surface and configured to stop movement of a spreading tool that is engaged with the engagement pin between the first and second towers.

2. The stabilizing device of claim 1, further comprising a traction element configured on the second surface, the traction element configured to increase traction between the base and a ground surface.

3. The stabilizing device of claim 2, wherein the traction element is integrally formed with the base.

4. The stabilizing device of claim 2, wherein the traction element is attached to the second surface.

5. The stabilizing device of claim 1, further comprising a first support extending from a surface of the first tower to the first surface of the base and a second support extending from a surface of the second tower to the first surface of the base.

6. The stabilizing device of claim 1, further comprising a locking mechanism configured to engage with the pin to secure the pin in the first and second apertures of the first and second towers.

7. The stabilizing device of claim 1, wherein the tower span is 2.25 inches.

8. The stabilizing device of claim 1, wherein the tower span is 1.625 inches.

9. The stabilizing device of claim 1, further comprising a recess formed in the first surface between the rail and the towers, the recess configured to receive a portion of the spreading tool to prevent movement of the spreading tool relative to the base.

10. The stabilizing device of claim 1, wherein the base has at least one dimension that is 6 inches.

11. The stabilizing device of claim 10, wherein a width and a length of the base are each 6 inches.

12. The stabilizing device of claim 9, wherein the recess does not extend a full width of the base.

13. The stabilizing device of claim 1, wherein, when the engagement pin reaches a top of the first and second apertures, an arm of the tool is secured and stabilized between the first and second towers to achieve a first degree of stability the arm of the tool is secured between the engagement pin and the base to achieve a second degree of stability.

14. The stabilizing device of claim 13, wherein, in the second degree of stability, a portion of the arm of the tool engages with at least one of a recess formed in the base and the rail.

15. The stabilizing device of claim 1, wherein each of the first aperture and the second aperture are located an aperture distance in the vertical direction from the first surface of the base.

16. The stabilizing device of claim 15, wherein at least one of the aperture length is 1.75 inches and the aperture distance is 2.5 inches.

* * * * *